US005480368A

United States Patent [19]

Huang

[11] Patent Number: 5,480,368

[45] Date of Patent: Jan. 2, 1996

[54] MUSCLE EXERCISER

[76] Inventor: Ming-Chih Huang, No. 33, Lane 1000, Chun Jih Road, Tao Yuan, Taiwan

[21] Appl. No.: 266,708

[22] Filed: Jun. 28, 1994

[51] Int. Cl.[6] ..... A63B 21/04; A63B 23/12

[52] U.S. Cl. ..... 482/123; 482/905

[58] Field of Search ..... 482/121, 122, 482/123, 124, 128, 129, 905

[56] References Cited

U.S. PATENT DOCUMENTS

| | | | |
|---|---|---|---|
| 4,209,167 | 6/1980 | Jansen | 482/123 |
| 4,343,465 | 8/1982 | Allen | 482/123 |
| 4,944,508 | 7/1990 | Collins | 482/121 |
| 5,042,799 | 8/1991 | Stanley | 482/123 |
| 5,178,596 | 1/1993 | McIntire | 482/909 |

FOREIGN PATENT DOCUMENTS

| | | | |
|---|---|---|---|
| 8903708 | 5/1989 | WIPO | 482/128 |

*Primary Examiner*—Lynne A. Reichard
*Attorney, Agent, or Firm*—Jacobson, Price, Holman & Stern

[57] ABSTRACT

A muscle exerciser including a base frame for placing on the table or the thigh, a lever pivotally connected to an axle holder on the base frame by a pivot axle, a ratchet wheel mounted around the pivot axle, an elastic member received inside the axle holder around pivot axle and having two opposite ends connected between the axle holder and the ratchet wheel, an adjusting knob for adjusting the tension of the elastic member, and a blocking means releasably meshed with the ratchet wheel permitting the elastic member to be compressed as the lever is pressed against the base frame, and a counter for counting the number of times that the lever has been continuously pressed.

5 Claims, 3 Drawing Sheets

MUSCLE EXERCISER

BACKGROUND OF THE INVENTION

The present invention relates to a muscle exerciser which comprises a lever pivotally connected to a base frame and pressed to compress an elastic member. When the lever is pressed down, a number is counted out by a counter and the elastic member is compressed; when the lever is released, the elastic member immediately pushes the lever back to its former position.

Various exercising apparatus have been disclosed for exercising and developing the muscles of the arms and the chest. A normal chest developer is generally comprised of two handles connected by a spring or springs. There is also know an exercising apparatus for exercising the muscle of the arms, comprised of a sleeve with a spring inside. The commonly drawback of these apparatus is that the tension of the spring (springs) or the number of the springs cannot be conveniently adjusted to fit different physical conditions or exercising requirements.

SUMMARY OF THE INVENTION

The present invention has been accomplished to provide a muscle exerciser which eliminates the aforesaid drawback.

According to one aspect of the present invention, the muscle exerciser comprises a base frame, a lever pivotally connected to an axle holder on the base frame by a pivot axle, a ratchet wheel mounted around the pivot axle, an elastic member mounted around the pivot axle and connected between the ratchet wheel and the axle holder, an adjusting knob coupled to the pivot axle and driven to turn the ratchet wheel in adjusting the tension of the elastic member, and a blocking means releasably meshed with the ratchet wheel permitting the elastic member to be compressed upon each down stroke of the lever.

According to another aspect of the present invention, the 1 base frame has a unitary handle for carrying by hand, and a recessed portion longitudinally disposed at the bottom for fitting over the thigh, and therefore the muscle exerciser can be placed on the thigh for exercising the muscles of the hand.

According to still another aspect of the present invention, the base frame comprises a counter connected to the lever through a circuit for counting the number of times that the lever has been continuously pressed.

According to still another aspect of the present inventions, the lever has an opening at the free end and a plurality of parallel grooves transversely disposed at two opposite sides, and therefore the user can positively hold the lever with the hand by inserting the thumb into the opening and attaching the other fingers to the grooves.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
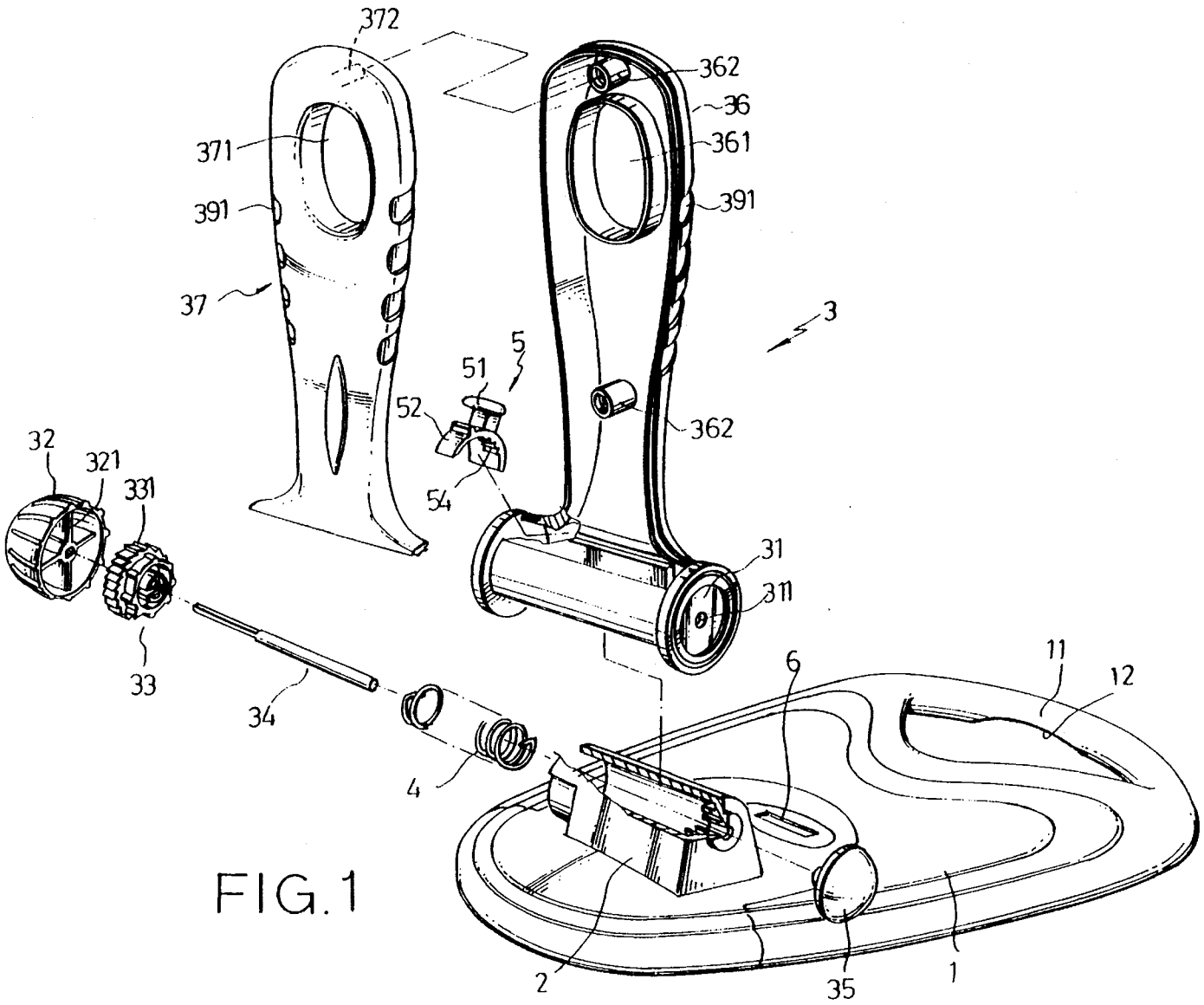
FIG. 1 is an exploded view of a muscle exerciser according to the present invention.

Referring to the annexed drawings, a muscle exerciser in accordance with the present invention is generally comprised of a base frame 1, an axle holder 2, a lever 3, an elastic member 4 and a catch 5 defining a blocking means 5.

Figure 3:
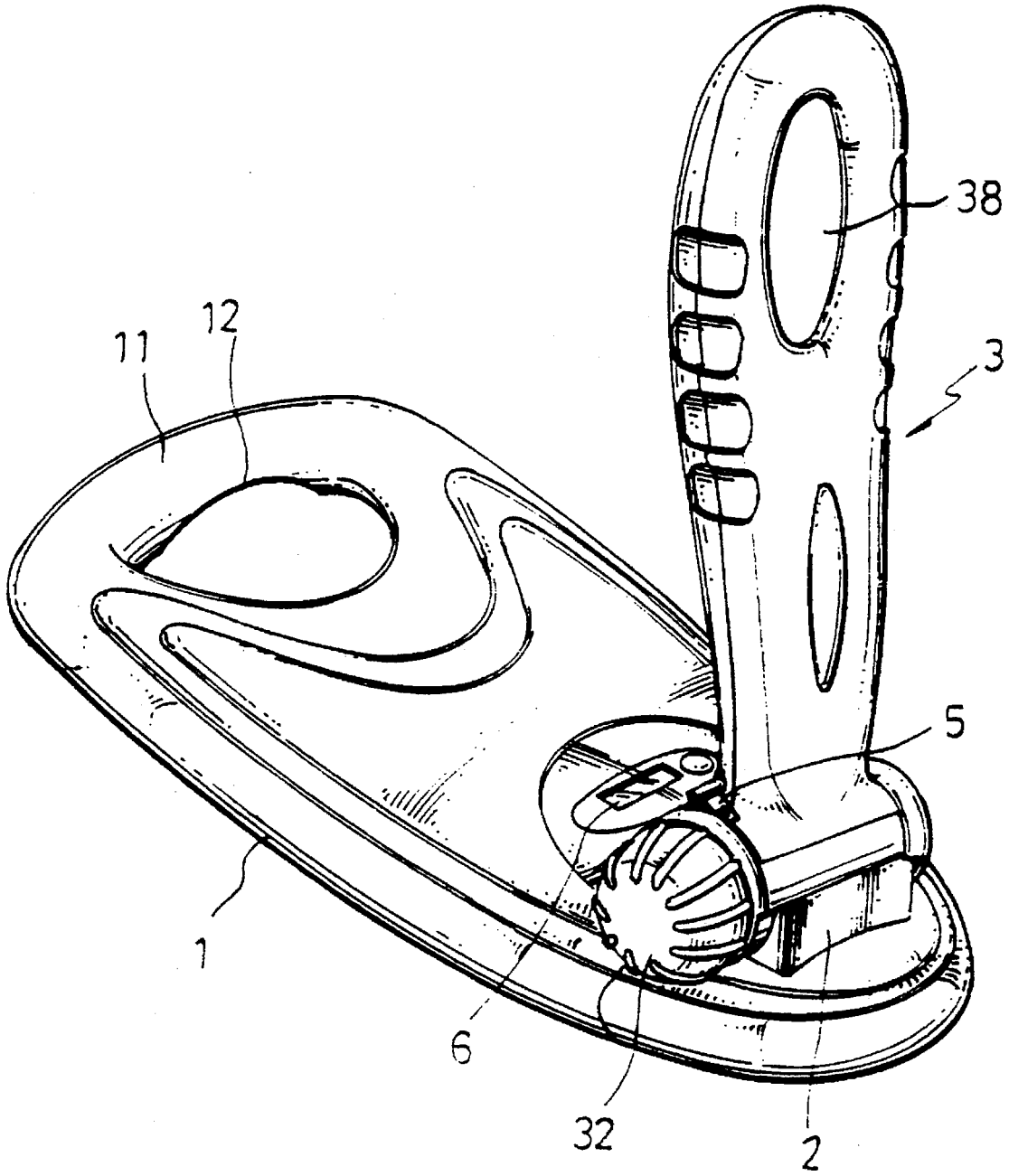
FIG. 3 is a perspective view of the muscle exerciser shown in FIG. 1.

Referring to FIGS. 1 and 3, the base frame 1 comprises a unitary handle 11 at one end, and a recessed portion 12 longitudinally disposed at the bottom for fitting over the thigh. The axle holder 2 is integrally made on the base frame 1 opposite to the handle 11. The lever 3 is pivotally connected to the axle holder 2. As illustrated, the lever 3 comprises two opposite side plates 31 with a respective axle hole 311 bilaterally disposed at one end. An adjusting knob 32 and a ratchet wheel 33 are coupled to one side plate 31 of the lever 3. The catch 5 is carried by the lever 3 for releasably meshing with the ratchet wheel 33. An elastic member 4 is received inside the axle holder 2, having one end coupled to one side of the ratchet wheel 33 and an opposite end fastened to one end of the axle holder 2. A pivot axle 34 is provided having one end connected to the adjusting knob 32 and an opposite end inserted through the ratchet wheel 33, the elastic member 4 and the axle holes 311 of the side plates 31 and then connected with an end cap 35 outside the axle holder 2. A counter 6 is mounted on the base frame 1 and connected to the lever 3 through a circuit ( not shown). The lever 3 comprises a lever arm 36 and a cover shell 37 covered on the lever arm 36. The lever arm 36 comprises a through hole 361 at a suitable location, and a plurality of unitary stub tubes 362 raised from the inside wall thereof. The cover shell 37 comprises a through hole 371 matched with the through hole 361 on the lever arm 36 to define an opening 38 on the lever 3, and a plurality of stub rods 372 raised from the inside wall thereof and respectively fitted into the stub tubes 362 on the lever arm 36. There are smoothly curved transverse grooves 391 made on the lever 3 at two opposite sides across the connecting area between the lever arm 36 and the cover shell 37 for the positive holding of the hand. The catch 5 comprises a curved base 52 fitting over the periphery of the ratchet wheel 33 and a finger strip 51 projected from the curved base 52. The curved base 52 of the catch 5 has a plurality of teeth 54 disposed at the bottom meshed with the teeth 331 of the ratchet wheel 33. When assembled, the finger strip 51 of the catch 5 extends out of the lever 3 adjacent the adjusting knob 32. Furthermore, the adjusting knob 32 has partition walls 321 on the inside stopped against the curved base 52 of the catch 5 at one side.

Figure 2:
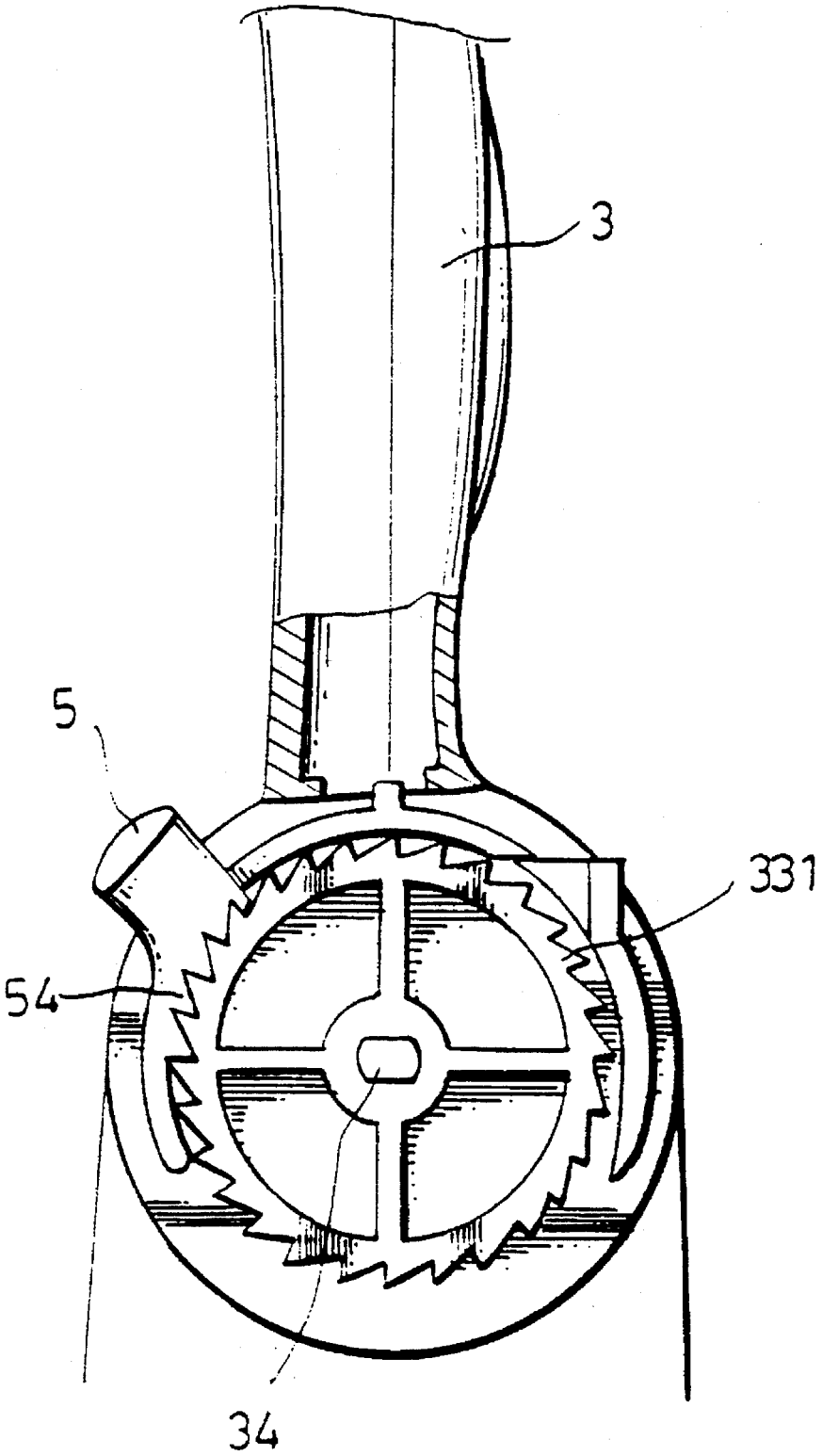
FIG. 2 is a partial view in section taken on FIG. 1, showing the ratchet wheel secured with the blocking means.

Referring to FIGS. 1, 2, and 3 again, the base frame 1 is placed on a table or the thigh, then the catch 5 is released from the teeth of the ratchet wheel 33 and the adjusting knob 32 is driven to turn the ratchet wheel 33 causing the elastic member 4 compressed. Therefore, the tension of the elastic member 4 is adjusted When adjusted, the ratchet wheel 33 is retained at the adjusted position by the catch 5. After the tension the elastic member 4 has been adjusted to the:desired level, the thumb of the hand is inserted through the opening 38 and the other four fingers of the hand are closely attached to the transverse grooves 391 to hold the lever 3. The hand is then exercised by alternatively pressing the lever 3 against the base frame 1 and then releasing it. At the same time, the counter 6 counts up how many times the lever 3 has been pressed down. Because the catch 5 is pivotally connected to the lever 3, it can be lifted from the teeth 331 of the ratchet wheel 33 permitting the ratchet wheel 3 to be turned in either direction by the adjusting knob 32 to adjust the tension of the elastic member 4 to the desired level. After each adjustment, the catch 5 is pushed back to stop the ratchet wheel 33 at the adjusted position. By means of the counter 6, the player knows how may times he (she) can press down the lever within a fixed length of time.

What is claimed is:

1. A muscle exerciser comprising:

a base frame having an axle holder mounted thereon;

a lever having one end pixotally connected to said axle holder by a pivot axle;

a ratchet wheel mounted around said pivot axle outside said axle holder;

an elastic means received inside said axle holder and mounted around said pivot axle, said elastic means having one end fixedly connected to said axle holder and an opposite end fixedly connected to said ratchet wheel;

a blocking means carried by said lever and releasably meshed with said ratchet wheel to permit said elastic means to be compressed upon each press of said lever; and an adjusting knob coupled to said pivot axle at one end and capable of being driven to turn said ratchet wheel to adjust the tension of said elastic means when said blocking means is released from said ratchet wheel wherein said lever comprises a lever arm and a cover shell covered on said lever arm, said lever arm comprising an opening at one end, two opposite side plates bilaterally disposed at an opposite end and mounted around said pivot axle, a plurality of unitary stub tubes raised from an inside wall thereof an a plurality of parallel grooves transversely disposed on two opposite sides thereof, said cover shell comprising an opening matching with the opening on said lever arm for the insertion of the thumb, a plurality of stub rods raised from an inside wall thereof and respectively fitted into said stub tubes, and a plurality of parallel grooves transversely disposed on two opposite sides thereof and respectively matched with the parallel grooves on said lever arm for the holding of the fingers.

2. A muscle exerciser comprising:

a base frame having an axle holder mounted thereon;

a lever having one end pivotally connected to said axle holder by a pivot axle;

a ratchet wheel mounted around said pivot axle outside said axle holder;

an elastic means received inside said axle holder and mounted around said pivot axle, said elastic means having one end fixedly connected to said axle holder and an opposite end fixedly connected to said ratchet wheel;

a blocking means carried by said lever and releasably meshed with said ratchet wheel to permit said elastic means to be compressed upon each press of said lever; and an adjusting knob coupled to said pivot axle at one end and capable of being driven to turn said ratchet wheel to adjust the tension of said elastic means when said blocking means is released from said ratchet wheel wherein said blocking means comprises a curved base fitting over the periphery of said ratchet wheel, and a finger strip raised from said curved base of said blocking means at the top for pulling with the fingers to release the blocking means from the ratchet wheel, said curved base having a plurality of teeth releasably meshed with respective teeth of said ratchet wheel.

3. A muscle exerciser comprising:

a base frame having an axle holder mounted thereon;

a lever having one end pivotally connected to said axle holder by a pivot axle;

a ratchet wheel mounted around said pivot axle outside said axle holder;

an elastic means received inside said axle holder and mounted around said pivot axle, said elastic means having one end fixedly connected to said axle holder and an opposite end fixedly connected to said ratchet wheel;

a blocking means carried by said lever and releasably meshed with said ratchet wheel to permit said elastic means to be compressed upon each press of said lever; and an adjusting knob coupled to said pivot axle at one end and capable of being driven to turn said ratchet wheel to adjust the tension of said elastic means when said blocking means is released from said ratchet wheel.

wherein said base frame comprises a recessed portion longitudinally disposed at the bottom for fitting over the thigh.

4. The muscle exerciser of claim 3, wherein said base frame comprises a unitary handle at one end for carrying by hand.

5. The muscle exerciser of claim 3 further comprising a counter mounted on said base frame for counting the number of times the said lever has been continuously pressed.

* * * * *